US006367796B2

(12) United States Patent
Iida

(10) Patent No.: US 6,367,796 B2
(45) Date of Patent: Apr. 9, 2002

(54) SHEET-LIKE OBJECT FEED UNIT IN SHEET-FED ROTARY PRINTING PRESS

(75) Inventor: Hirotaka Iida, Ibaragi (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/752,905

(22) Filed: Dec. 26, 2000

(30) Foreign Application Priority Data

Dec. 27, 1999 (JP) ..... 11-369413

(51) Int. Cl.[7] ..... B65H 7/02

(52) U.S. Cl. ..... 271/259; 271/258.01; 271/69; 271/85; 198/464.4

(58) Field of Search ..... 271/258.01, 259, 271/268, 69, 85; 198/464.4

(56) References Cited

U.S. PATENT DOCUMENTS 3,647,205 A * 3/1972 Schone et al. ..... 271/258.01
5,440,983 A * 8/1995 Dopke et al. ..... 271/268

FOREIGN PATENT DOCUMENTS

JP 57-182443 11/1982
JP 4-347641 12/1992

* cited by examiner

*Primary Examiner*—H. Grant Skaggs
(74) *Attorney, Agent, or Firm*—Blakely Sokoloff Taylor & Zafman

(57) ABSTRACT

A sheet-like object feed unit in a sheet-fed rotary printing press includes a feedboard, paper feed belts, connecting plate, improper paper feeding detector, swing arm shaft pregripper, transfer cylinder, non-motion roller, gripper closing cam, and air cylinder. The feedboard, paper feed belts, and connecting plate convey a sheet-like object. The improper paper feeding detector is disposed on a sheet-like object convey path including the feedboard, paper feed belts, and connecting plate, and detects improper feeding of the sheet-like object. The swing arm shaft pregripper is disposed downstream of the feedboard, paper feed belts, and connecting plate in a sheet-like object convey direction, and has a first holding unit for holding the sheet-like object conveyed by the feedboard, paper feed belts, and connecting plate. The transfer cylinder is disposed downstream of the swing arm shaft pregripper in the sheet-like object convey direction, and has a second holding unit for holding the sheet-like object held by the swing arm shaft pregripper. The non-motion roller, gripper closing cam, and air cylinder disable the second holding unit when the improper paper feeding detector detects improper feeding of the sheet-like object.

11 Claims, 6 Drawing Sheets

SHEET-LIKE OBJECT FEED UNIT IN SHEET-FED ROTARY PRINTING PRESS

BACKGROUND OF THE INVENTION

The present invention relates to a sheet-like object feed unit in a sheet-fed rotary printing press, which prevents a sheet-like object from being fed to a printing unit in an abnormal state.

Conventionally, in a sheet-fed rotary printing press, a sheet fed out from a feed unit is conveyed on a feeder board and feedboard, and is jogged in the circumferential direction by the front lay of a registration unit provided at the distal end of the feedboard. The sheet jogged in the circumferential direction is gripped by the gripper of a swing arm shaft pregripper, and is supplied to the impression cylinder of a printing unit through gripping change from the gripper of the swing arm shaft pregripper to the gripper of the impression cylinder. An improper paper feeding detecting means for detecting that a conveyed sheet moves over the front lay or two sheets are fed in an overlaying state, i.e., abnormal or defective paper feeding, is provided at the distal end of the feedboard. When the improper paper feeding detecting means detects improper paper feeding, impression throw-off is performed, and printing is stopped.

In an improper paper feeding detecting apparatus disclosed in Japanese Patent Laid-Open No. 4-347641, an improper paper feeding detector for detecting whether improper paper feeding has occurred and generating a corresponding signal is provided to a registration unit. If the improper paper feeding detector does not detect improper paper feeding, printing is continued in the impression throw-on state. If the improper paper feeding detector detects improper paper feeding, the printing cylinders of all the printing units are disengaged and the printing operation is stopped. At this time, paper conveyance is stopped by a front lay, and the sheets are left in the registration unit so as not be supplied to the printing units.

In the conventional sheet-fed rotary printing press with the improper paper feeding detecting apparatus described above, even when the improper paper feeding detector detects occurrence of improper paper feeding, sometimes paper conveyance cannot be stopped by the front lay well in time. If the sheet is fed over the front lay, it sometimes undesirably reaches the impression cylinder of a printing unit. In this case, the sheet is gripped by the gripper of the impression cylinder, and is conveyed to the delivery unit through gripping change between the grippers of the respective cylinders. During conveyance, if the improperly fed sheet is bent, it applies an excessive printing pressure to the printing cylinder. In particular, when a plurality of sheets are bent, they apply a large pressure, thus damaging the jacket of the impression cylinder and the blanket of the blanket cylinder.

SUMMARY OF THE INVENTION

It is an object of the present invention to provide a sheet-like object feed unit in a sheet-fed rotary printing press, which does not damage the surface of a printing cylinder even if improper paper feeding occurs.

In order to achieve the above object, according to the present invention, there is provided a sheet-like object feed unit in a sheet-fed rotary printing press, comprising a convey unit for conveying a sheet-like object, improper feeding detecting means, disposed on a sheet-like object convey path including the convey unit, for detecting improper feeding of the sheet-like object, a first holding unit disposed downstream of the convey unit in a sheet-like object convey direction and having first holding means for holding the sheet-like object conveyed by the convey unit, a second holding unit disposed downstream of the first holding unit in the sheet-like object convey direction and having second holding means for holding the sheet-like object held by the first holding unit, and first disable means for disabling the second holding means when the improper feeding detecting means detects improper feeding of the sheet-like object.

DESCRIPTION OF THE PREFERRED EMBODIMENT

The present invention will be described in detail with reference to the accompanying drawings.

Figure 1:
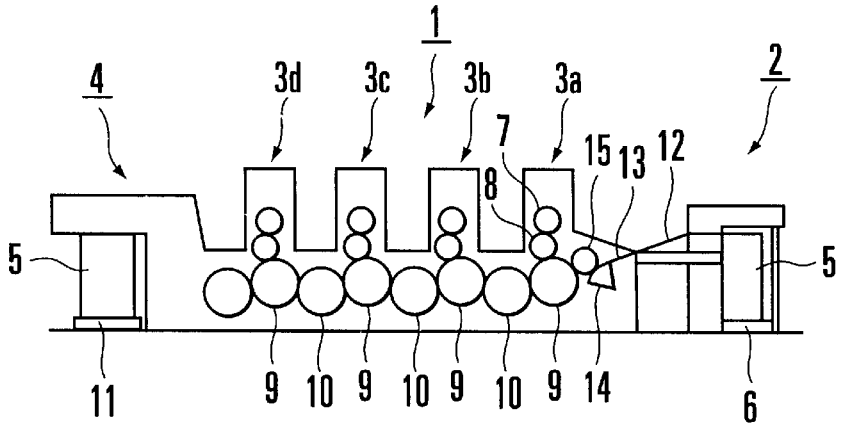
FIG. 1 is a side view schematically showing a sheet-fed rotary printing press to which the present invention is applied.

FIG. 1 shows the overall arrangement of a sheet-fed rotary printing press according to an embodiment of the present invention. Referring to FIG. 1, a sheet-fed rotary printing press 1 has a feed unit 2 with a pile board 6 on which sheets 5 are stacked, a plurality of printing units 3*a* to 3*d* subordinately arranged to perform printing, in four colors, on the sheets 5 fed from the feed unit 2, and a delivery unit 4 for delivering the sheets 5 conveyed from the fourth-color printing unit 3*d*. Each of the printing units 3*a* to 3*d* has a plate cylinder 7 with a plate mounted on its circumferential surface, an inker and dampener (not shown) for supplying ink and dampening water to the surface of the plate, a blanket cylinder 8 in contact with the plate cylinder 7, and an impression cylinder 9 in contact with the blanket cylinder 8.

Transfer cylinders 10 disposed among the respective impression cylinders 9 of the printing units 3*a* to 3*d* to be in contact with them. The delivery unit 4 has a delivery chain (not shown) for conveying the sheets 5 printed by the fourth-color printing unit 3*d*, and a pile board 11 on which the sheets 5 delivered as they are conveyed by the delivery chain are stacked. A feeder board 12, feedboard 13, swing arm shaft pregripper 14, and transfer cylinder 15 are disposed between the feed unit 2 and the first-color printing unit 3*a*.

Figure 2:
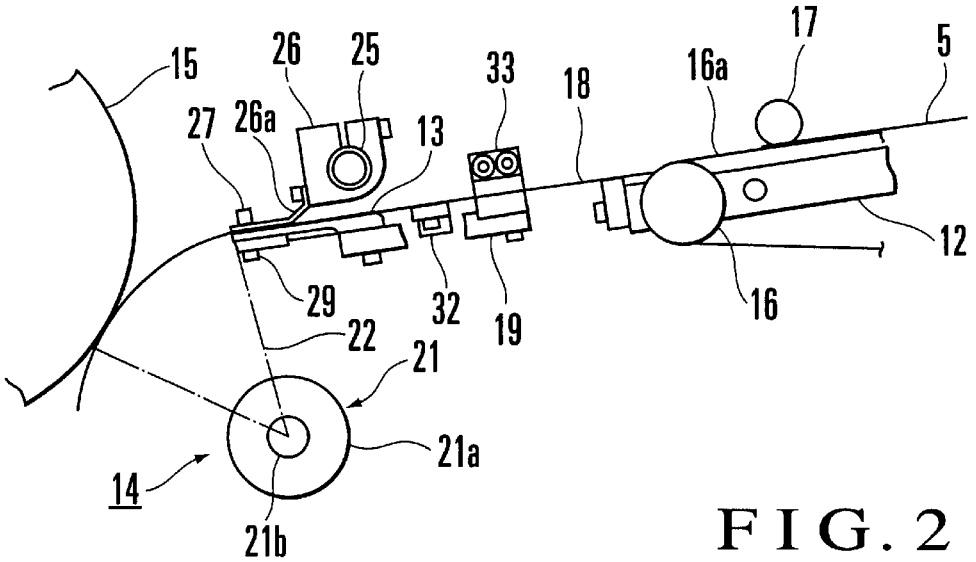
FIG. 2 is a side view of a sheet feed unit according to an embodiment of the present invention.

The feeder board 12 and feedboard 13 will be described in detail with reference to FIGS. 2 and 3. Referring to FIG. 2, a plurality of paper feed belts 16*a* are applied parallel to each other along the feeder board 12 which is inclined in contact with a belt roller 16. The paper feed belts 16*a* cooperate with a pressure roller 17 to convey the sheets 5 on the feeder board 12. The elongated plate-like feedboard 13 is arranged in front of the feeder board 12 in the paper convey direction and is supported through a connecting plate 18 at the same angle of inclination as that of the feeder board 12. A support plate 19 extends between a pair of opposing frames 20 (see FIG. 5) to support the connecting plate 18 and feedboard 13.

The swing arm shaft pregripper 14 is comprised of a swing arm shaft 21 in which the axes of an outer surface 21*a* and eccentric shaft 21*b* supported by bearings are eccentric, an arm 22 pivotal together with the swing arm shaft 21, and a swing arm gripper 23 supported at the distal end of the arm 22. The swing arm shaft pregripper 14 is so-called a lower swing in which the swing arm shaft 21 is arranged below the feedboard 13 serving as the convey path for the sheets 5, and the swing arm gripper is provided at the distal end of the swing arm shaft pregripper 14. The swing arm shaft pregripper 14 grips, with its swing arm gripper 23, a sheet 5 stopped by the front lay (not shown) at the distal end of the feedboard 13, and conveys it as the arm 22 pivots, so that gripping change is performed with a gripper 43 (to be described later; see FIG. 4) of the transfer cylinder 15.

The front lay is an arrangement known to the person skilled in the art, as is disclosed in Japanese Patent Laid-Open No. 57-182443. The contents of Japanese Patent Laid-Open No. 57-182443 are incorporated in this specification.

Figure 3:
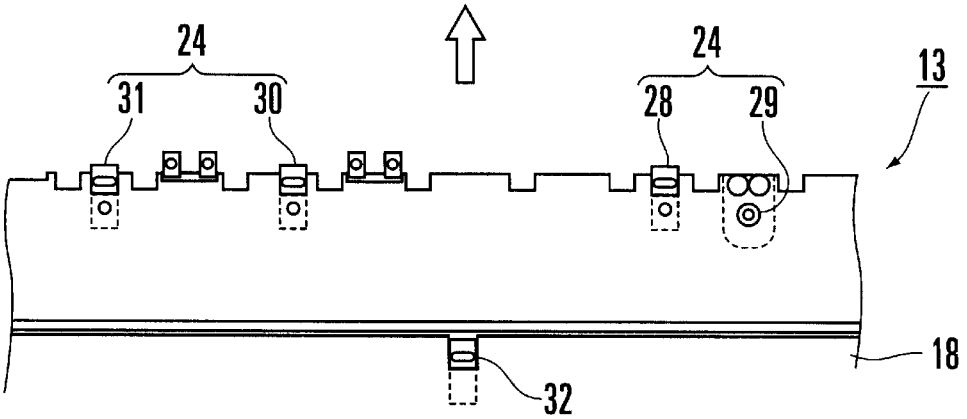
FIG. 3 is a plan view of the feedboard of the sheet feed unit shown in FIG. 2.

As shown in FIG. 3, an overreaching detector 28, a double-sheet detector 29, a pair of sheet skew detectors 30 and 31, and an impression throw-in detector 32 are attached to the feedboard 13. The detectors 28 to 32 are comprised of pairs of opposing light-emitting and light-receiving elements to constitute an improper paper feeding detector 24. FIG. 3 shows the light-receiving elements of the detectors 28 to 32, and the paper convey direction with an arrow. Above the feedboard 13, as shown in FIG. 2, a holder 26 is fixed by split clamping to a support shaft 25 extending between the pair of frames 20. Light-receiving elements 27 of the detectors 28 to 32 are mounted on the holder 26 through a bracket 26*a* substantially in a row such that their light-receiving surfaces face down.

The light-emitting element of the overreaching detector 28 is fixed to the lower surface of the feedboard 13 with a bolt with its light-emitting surface facing up to oppose the corresponding light-receiving element. When the sheet 5 conveyed to the feedboard 13 moves over the front lay (not shown), light is blocked by the sheet 5. The overreaching detector 28 detects this and outputs an abnormal signal.

The light-emitting element of the double-sheet detector 29 is fixed to the lower surface of the feedboard 13, disposed slightly upstream of the front lay in the paper convey direction, with a bolt with its light-emitting surface facing up to oppose the corresponding light-emitting element. While the sheets 5 should be conveyed onto the feedboard 13 one by one, if two sheets are fed in an overlaying state, the double-sheet detector 29 detects a change in light transmittance due to the sheets 5 and outputs an abnormal signal.

The light-transmitting elements of the sheet skew detectors 30 and 31 are fixed to the lower surface of the feedboard 13 with bolts with their light-transmitting surfaces facing up to oppose the corresponding light-receiving elements. When the sheet 5 conveyed onto the feedboard 13 is stopped such that its leading end is not perpendicular to the paper convey direction, the sheet skew detectors 30 and 31 detect this on the basis of the combinations of the outputs of the two light-receiving elements, and output an abnormal signal.

The impression throw-in detector 32 for detecting the impression throw-in timing when the sheet 5 passes above it is fixed to the front end of the connecting plate 18 in the paper convey direction. A side lay unit 33 which causes the end of the sheet 5 under conveyance to abut against the gauge and registers the sheet 5 in the right-to-left direction is attached to the end of the connecting plate 18 in a direction perpendicular to the paper convey direction.

Figure 4:
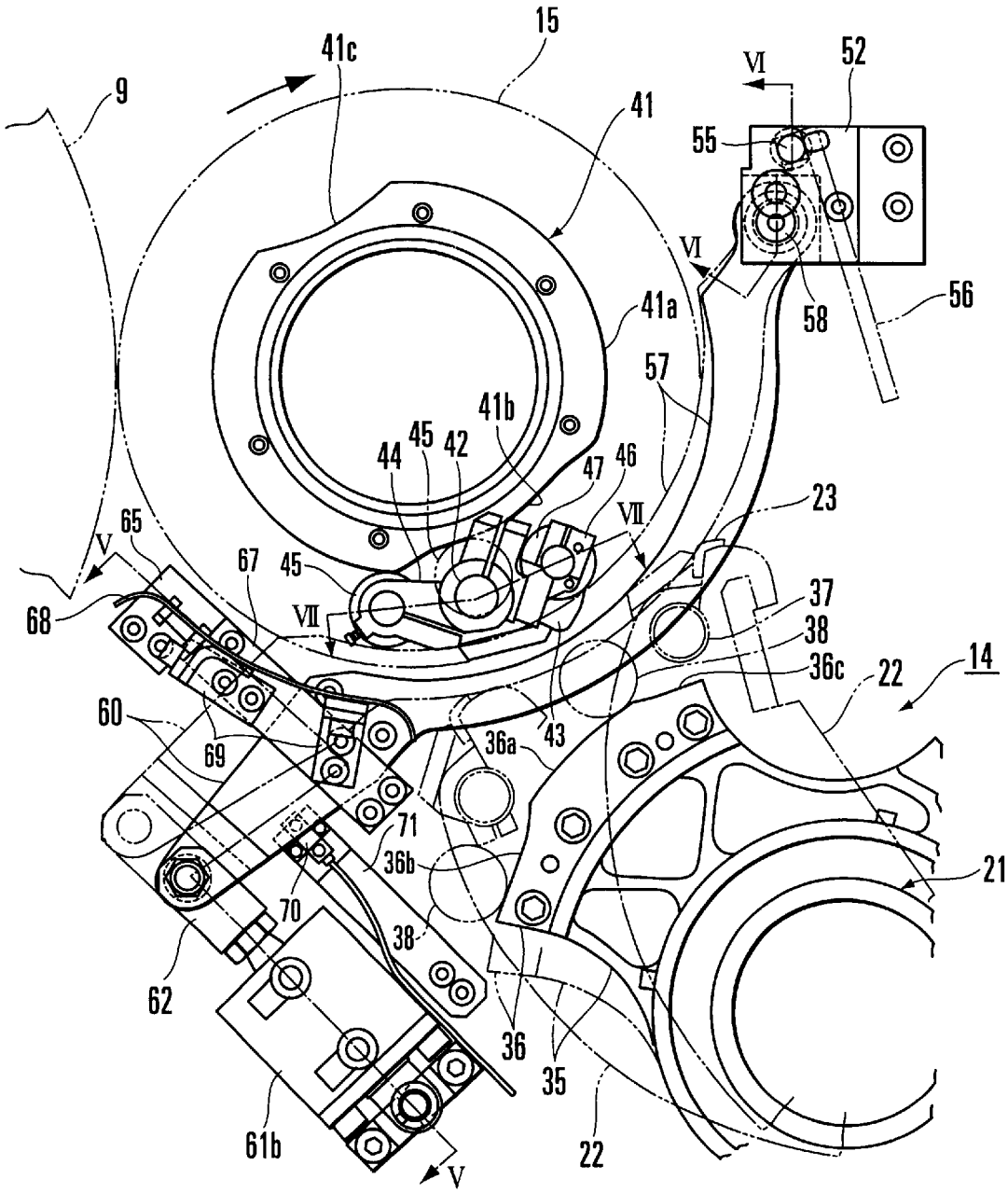
FIG. 4 is a side view showing the main part of the sheet feed unit shown in FIG. 2.

The opening/closing operation of the swing arm gripper 23 of the swing arm shaft pregripper 14 will be described with reference to FIG. 4. Referring to FIG. 4, in the swing arm shaft pregripper 14, a pivotal swing arm gripper opening/closing cam 35 is supported by the swing arm shaft 21. The swing arm gripper opening/closing cam 35 is swung by an air cylinder 61*a* (FIG. 8) between the position of the solid line and that of the alternate long and two short dashed line in FIG. 4. A cam member 36 is fixed to the swing arm gripper opening/closing cam 35. The cam member 36 has, on its circumferential surface, a high cam surface 36*a* at its center and low cam surfaces 36*b* and 36*c* at its two ends.

The arm 22 pivotally supports a gripper shaft 37. The proximal end of the swing arm gripper 23 is axially mounted on the gripper shaft 37 so the swing arm gripper 23 pivots together with the gripper shaft 37. One end of a swing arm gripper opening/closing roller 38 is fixed to the other end of a lever (not shown) axially mounted to the gripper shaft 37, and is biased to abut against the cam surface of the cam member 36. With this arrangement, when the arm 22 swings and the swing arm gripper 23 is positioned at the distal end of the feedboard 13 described above, the swing arm gripper opening/closing roller 38 moves from the low cam surface 36*c* to abut against the high cam surface 36*a*. Hence, the swing arm gripper 23 pivots clockwise in FIG. 4 about the gripper shaft 37 as the pivot center, and is closed to grip a sheet 5 stopped by the front lay (not shown) at the distal end of the feedboard 13.

After gripping the sheet 5, when the arm 22 pivots counterclockwise in FIG. 4 about the swing arm shaft 21 as the pivot center, the swing arm gripper opening/closing roller 38 abuts against the low cam surface 36*b* to open the swing arm gripper 23. Thus, the sheet 5 is transferred to the gripper 43 of the transfer cylinder 15 through gripping change.

If the improper paper feeding detector 24 described above detects improper paper feeding, the swing arm gripper opening/closing cam 35 is pivoted by the air cylinder 61*a* (FIG. 8) counterclockwise in FIG. 4 about the swing arm shaft 21 as the pivot center, and is positioned at the position indicated by the alternate long and two short dashed line. Therefore, even when the swing arm gripper 23 is located at the distal end of the feedboard 13, since the swing arm gripper opening/closing roller 38 abuts against the other low cam surface 36*c* to open the swing arm gripper 23, the swing arm gripper 23 will not grip the sheet 5 stopped by the front lay (not shown) at the distal end of the feedboard 13. As a result, the improperly fed sheet 5 is not supplied from the transfer cylinder 15 to the respective printing units 3 located on the downstream side, so the surfaces of the blanket cylinders 8, impression cylinder 9, and transfer cylinder 10 of the respective printing units 3*a* to 3*d* will not be damaged.

The swing arm gripper opening/closing cam 35, swing arm gripper opening/closing roller 38, and air cylinder 61*a* constitute the second disable means of the swing arm gripper 23.

The opening/closing operation of the gripper 43 of the transfer cylinder 15 will be described with reference to FIGS. 4 and 7. Referring to FIG. 4, a circular disk-shaped gripper opening/closing cam 41 is fixed to the frame 20. The gripper opening/closing cam 41 has, on its circumferential surface, a high cam surface 41*a* and two low cam surfaces 41*b* and 41*c* which are formed apart from each other at an angular interval of about 180° in the circumferential direction. A bearer 40 of the transfer cylinder 15 pivotally supports a gripper shaft 42. The proximal end of a gripper 43 is axially mounted to the gripper shaft 42, so the gripper 43 pivots together with the gripper shaft 42. The central portion of a lever 44 is axially mounted to the gripper shaft 42. A gripper opening/closing roller 45 is fixed to one end of the lever 44, and a non-motion roller 47 serving as a gripping change regulating member is fixed to the other end of the lever 44 through a bracket 46.

Figure 7:
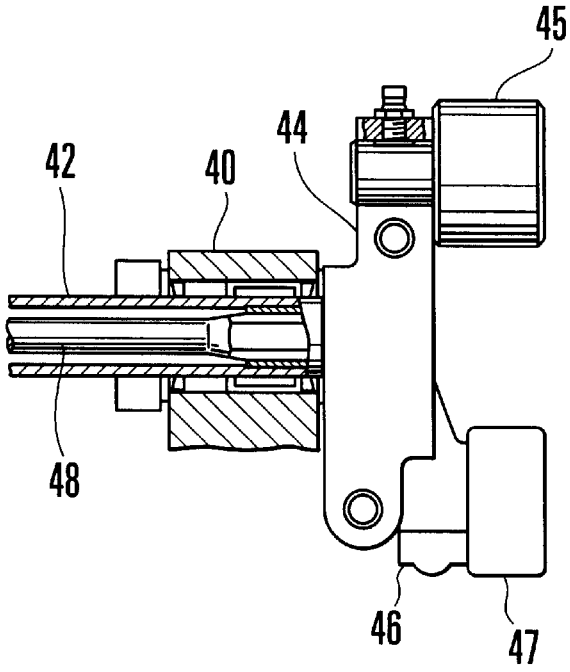
FIG. 7 is a sectional view taken along the line VII—VII of FIG. 4.

As shown in FIG. 7, one end of a torsion bar 48 is axially mounted to one end of the gripper shaft 42. A pivot moment in the counterclockwise direction in FIG. 4 is constantly applied to the gripper shaft 42 by the torsional moment of the torsion bar 48. Also, the gripper opening/closing roller 45 is pressed against the circumferential surface of the gripper opening/closing cam 41. With this arrangement, when the transfer cylinder 15 rotates and the gripper 43 is positioned at the paper gripping change position (the position indicated by the solid line in FIG. 4) where it receives the sheet from the swing arm gripper 23 described above, the gripper opening/closing roller 45 abuts against the low cam surface 41*b* of the gripper opening/closing cam 41, so that the gripper shaft 42 pivots clockwise in FIG. 4 to open the gripper 43.

When the transfer cylinder 15 pivots subsequently, the gripper opening/closing roller 45 abuts against the high cam surface 41*a,* and accordingly the gripper shaft 42 pivots counterclockwise in FIG. 4 to close the gripper 43. When the gripper 43 is opened and closed in this manner, it performs sheet gripping change with the swing arm gripper 23. When the transfer cylinder 15 further rotates and the gripper opening/closing roller 45 abuts against the low cam surface 41*c,* the gripper 43 is opened so the sheet 5 gripped by it is transferred to the gripper (not shown) of the impression cylinder 9 through gripping change.

The operation of regulating gripping change by the gripper 43 will be described with reference to FIGS. 4, 5, and 6. Referring to FIGS. 4 and 6, a support member 52 fixed to the frames 20 has a recess 53 extending from its lower surface to its side surface, and a through hole 54 extending perpendicularly to the recess 53. A shaft 55 extends through the support member 52 and is rotatably supported by the frame 20. A cover 56, rotatable about the shaft 55 as the rotation center so as to open/close, is attached to the shaft 55.

An arched gripper closing cam 57 serving as a cam member has one end engaged in the recess 53 of the support member 52, as shown in FIG. 6. The gripper closing cam 57 is supported to be pivotal about a pin 58, inserted in a through hole 57*a* formed on its end engaged in the recess 53 and in the through hole 54 of the support member 52, as the pivot center. One end of a lever 60 is fixed to the other end of the gripper closing cam 57, and the other end of the lever 60 is pivotally mounted to a rod 62 of an air cylinder 61*b* fixed to the frame 20.

During printing operation, the rod 62 of the air cylinder 61*b* is kept retracted, and the gripper closing cam 57 is kept retreated from the non-motion roller 47, i.e., is located at the position indicated by the solid line in FIG. 4. When the improper paper feeding detector 24 detects improper paper feeding, the rod 62 of the air cylinder 61*b* moves forward. Thus, the gripper closing cam 57 slightly pivots clockwise in FIG. 4 about the pin 58 as the pivot center, and is positioned at the position indicated by the alternate long and two short dashed line, so that it abuts against the non-motion roller 47, thereby forcibly closing the gripper 43.

The non-motion roller 47, gripper closing cam 57, and air cylinder 61*b* constitute the first disable means of the gripper 43.

Figure 5:
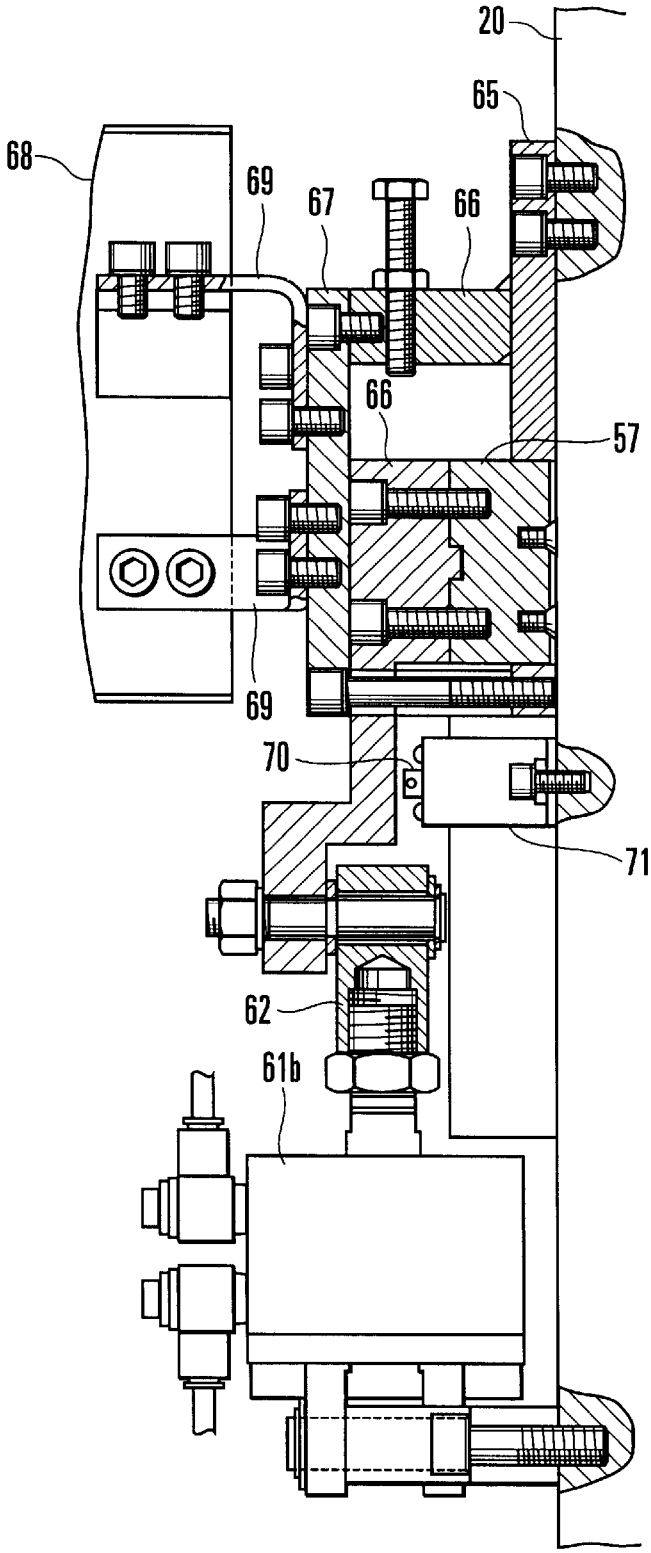
FIG. 5 is a sectional view taken along the line V—V of FIG. 4.
Figure 6:
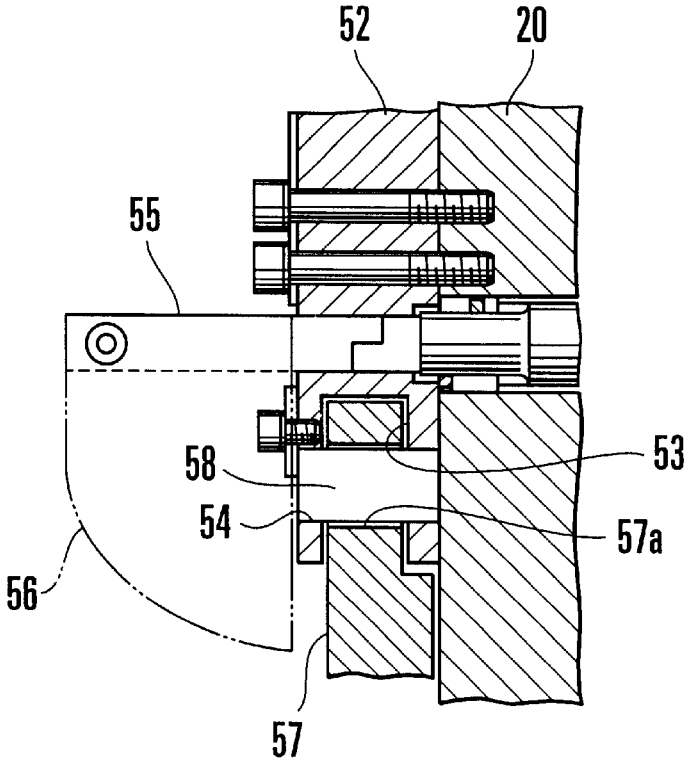
FIG. 6 is a sectional view taken along the line VI—VI of FIG. 4.

Referring to FIGS. 4 and 5, a support plate 67 is fixed to the base plate 65, fixed to the frames 20, through a stud 66. A paper guide 68 fixed to the support plate 67 through metal fixtures 69 has a curved section, and extends in the axial direction of the transfer cylinder 15 to be close to its circumferential surface. When the rod 62 of the air cylinder 61*b* is retracted and the lever 60 returns to the home position, a home position return checking sensor 70 fixed to the frame 20 through a bracket 71 detects this, and enables printing operation.

Figure 8:
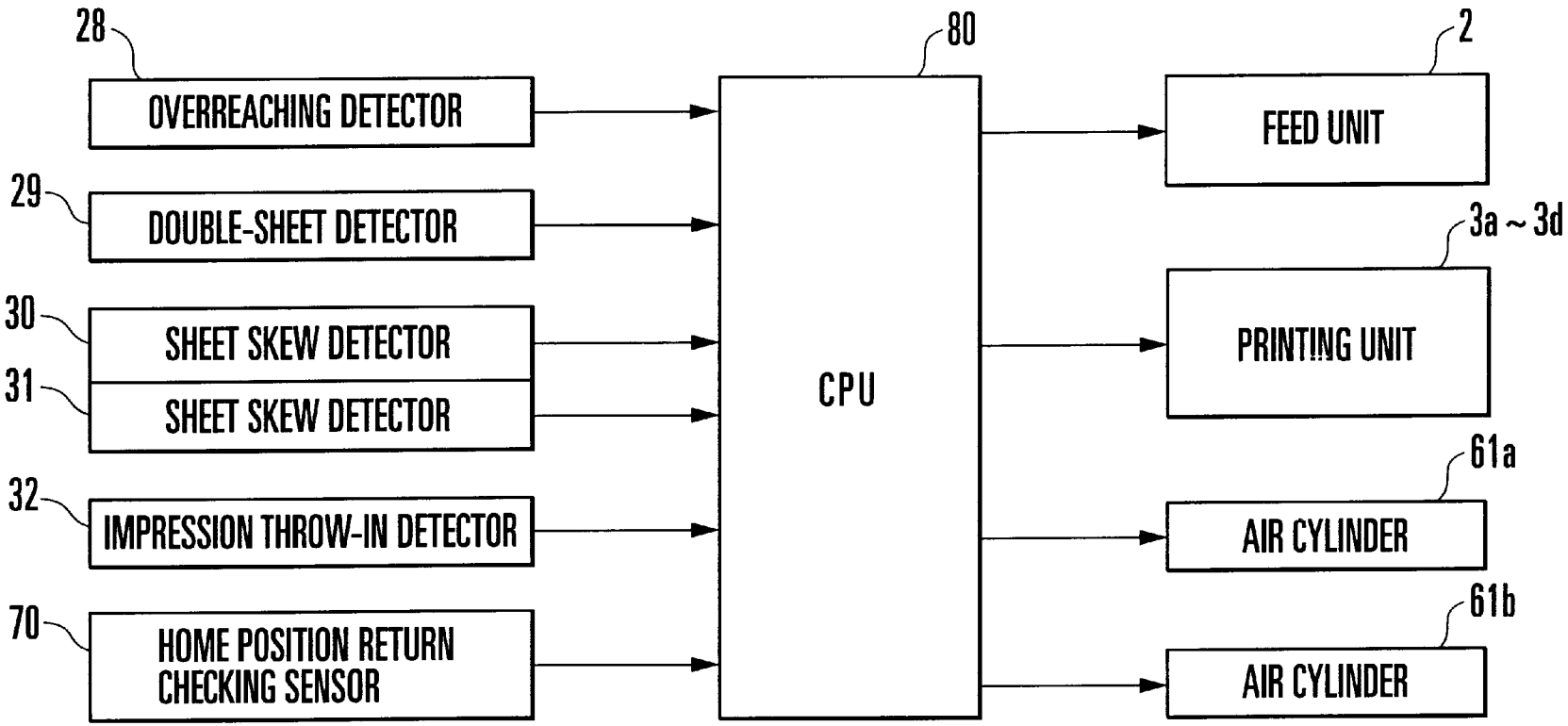
FIG. 8 is a block diagram of the sheet-fed rotary printing press with the sheet feed unit shown in FIG. 2.

FIG. 8 shows functional blocks of the sheet-fed rotary printing press described above. Referring to FIG. 8, the detection signals from the detectors 28 to 32 constituting the improper paper feeding detector 24 are output to a CPU (Central Processing Unit) 80. The CPU 80 controls the feed unit 2, printing units 3*a* to 3*d,* and air cylinders 61*a* and 61*b* on the basis of the detection signals from the detectors 28 to 32, and performs paper feed operation including a countermeasure for improper paper feeding.

Figure 9:
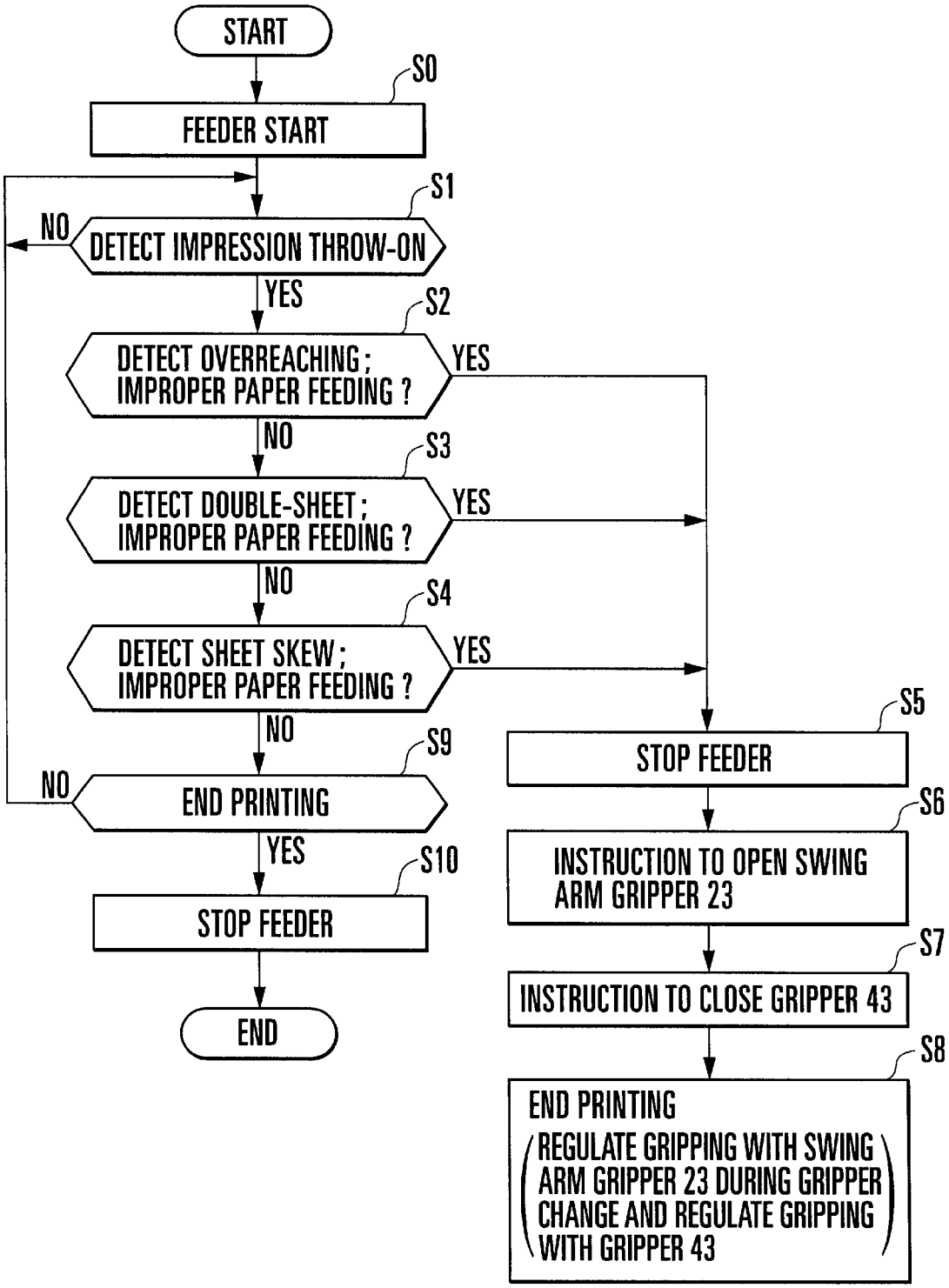
FIG. 9 is a flow chart for explaining the printing operation of the sheet-fed rotary printing press with the sheet feed unit shown in FIG. 2.

Sheet-like object feed operation in the sheet-fed rotary printing press with the above arrangement will be described with reference to the flow chart of FIG. 9. First, the CPU 80 drives the feed unit 2, so the sheet 5 is conveyed onto the connecting plate 18 by the paper feed belts 16*a* through the feeder board 12 (step S0). At this time, when the leading end of the sheet 5 is detected by the impression throw-in detector 32, the CPU 80 outputs a cylinder engagement instruction to the respective printing units 3*a* to 3*d* (step S1).

Subsequently, the sheet 5 is further conveyed from the connecting plate 18 onto the feedboard 13, and is stopped by the front lay as the conveyance is regulated. If the sheet 5 is properly fed, none of the detectors 28 to 31 constituting the improper paper feeding detector 24 outputs an abnormal signal in steps S2 to S4. The sheet 5 is thus fed to the transfer cylinder 15 by the swing arm shaft pregripper 14, and printing operation is started.

If improper paper feeding occurs at the start of printing or during printing, at least one of the detectors 28 to 31 constituting the improper paper feeding detector 24 detects improper paper feeding, and outputs an abnormal signal (steps S2 to S4). Upon reception of the abnormal signal from any one of the detectors 28 to 31, the CPU 80 stops the sheets 5 (step S5), and drives the air cylinder 61*a* to open the swing arm gripper 23 (step S6). Subsequently, the CPU 80 drives the air cylinder 61*b* to close the gripper 43 (step S7).

The CPU 80 performs impression throw-off of the printing units 3*a* to 3*d* to stop printing operation (step S8). At this time, the gripping operation of the swing arm gripper 23 to grip the sheet 5 stopped at the front lay is regulated, and simultaneously gripping change by the gripper 43 of the transfer cylinder 15 is regulated. More specifically, upon operation of the air cylinder 61*a,* the swing arm gripper opening/closing cam 35 pivots counterclockwise in FIG. 4 about the swing arm shaft 21 as the pivot center, and is positioned at the position indicated by the alternate long and two short dashed line.

Even when the swing arm gripper 23 moves to the distal end of the feedboard 13, the swing arm gripper opening/closing roller 38 is in contact with the other low cam surface 36*c*. The swing arm gripper 23 is thus opened from a gripper pad 39, and does not grip the sheet 5 stopped by the front lay (not shown) at the distal end of the feedboard 13. Hence, the improperly fed sheet 5 is not supplied from the transfer cylinder 15 to the respective printing units 3 downstream of the transfer cylinder 15, and the surfaces of the plate cylinders 7, blanket cylinders 8, impression cylinders 9, and transfer cylinders 10 of the respective printing units 3 will not be damaged by the improperly fed sheet 5.

A stopping means for stopping gripping change of the gripper 43 is constituted by the non-motion roller 47, gripper closing cam 57 for setting the non-motion roller 47 in the non-motion state, and air cylinder 61*b* for actuating the gripper closing cam 57. The number of components is thus minimized to simplify the structure, and gripping change of the gripper 43 is regulated reliably.

In this embodiment, since the swing arm shaft pregripper 14 is the lower swing, even if the improperly fed sheet 5 is not gripped by the swing arm gripper 23, it may sometimes be erroneously guided by the swing arm gripper 23 of the swing arm shaft pregripper 14 to slide on the swing arm gripper 23 and be conveyed to the transfer cylinder 15. Even in this case, the improper paper feeding detector 24 detects improper paper feeding. The air cylinder 61*b* is thus driven and the gripper closing cam 57 is positioned at the position indicated by the alternate long and two short dashed line in FIG. 4, where it is in contact with the non-motion roller 47. Hence, even if the gripper opening/closing roller 45 opposes the low cam surface 41*b* of the gripper opening/closing cam 41, the gripper shaft 42 will not pivot.

Since the gripper 43 does not open but is kept in the closed state, the improperly fed sheet 5 erroneously conveyed to the transfer cylinder 15 will not be gripped by the gripper 43. Accordingly, the improperly fed sheet 5 is not conveyed to the respective printing units 3*a* to 3*d* located downstream of the transfer cylinder 15 in the paper convey direction, and is not delivered to the delivery unit 4. As a result, the surfaces of the plate cylinders 7, blanket cylinders 8, impression cylinders 9, and transfer cylinders 10 of the respective printing units 3 will not be damaged by the improperly fed sheet 5. Since the improperly fed sheet 5 is not conveyed downstream of the transfer cylinder 15 in the paper convey direction but stays on the feedboard 13, it can be removed easily.

After the improperly fed sheet 5 is removed, when printing is to be started again, the CPU 80 sets the air cylinder 61*b* in the non-motion state to retract the rod 62, and retracts the gripper closing cam 57, through the lever 60, to a retreat position indicated by the solid line in FIG. 4, where it is retreated from the non-motion roller 47. At this time, the home position return checking sensor 70 recognizes that the gripper closing cam 57 has moved to this position, and then printing is started, so the gripper 43 does not fail to grip. Therefore, the surfaces of the plate cylinders 7, blanket cylinders 8, impression cylinders 9, and transfer cylinders 10 will not be damaged by the sheet 5 that has failed to be gripped.

In this embodiment, the swing arm shaft pregripper 14 is used as the first holding unit. However, the first holding unit may be the transfer cylinder 15. Also, although the transfer cylinder 15 is used as the second holding unit, the second holding unit may be the impression cylinder 9. It suffices if the holding unit is a sheet-like object holding unit with a sheet-like object holding means for transferring a sheet-like object. In this embodiment, the sheet-like object is a paper sheet. Alternatively, the sheet-like object may be a film made of, e.g., polyvinyl chloride.

Upon detection by the improper paper feeding detector 24, only the swing arm gripper 23 is opened and the gripper 43 is closed. Alternatively, the impression throw-on instruction may be canceled simultaneously, and all the cylinders may be set in the impression throw-off state. The air cylinder 61*b* may be set in the opposite direction, and when the rod 62 is retracted, the gripper closing cam 57 may set the non-motion roller 47 in the non-motion state. As an actuator, a motor rotatable in the forward/reverse direction may be used in place of the air cylinder 61*b*, a screw rod may be provided as the rotation shaft of the motor, and a threaded portion threadably engageable with this screw rod may be formed on the lever 60.

As has been described above, according to the present invention, even when abnormal or defective feeding of a sheet-like object occurs, transfer of the sheet-like object from the first holding means to the second holding means is regulated. Thus, the surfaces of cylinders downstream of the first holding means in the sheet-like object convey direction may not be damaged by a bent sheet-like object.

Also, the structure is simplified, and gripping change is regulated reliably.

What is claimed is:

1. A sheet-like object feed unit in a sheet-fed rotary printing press, comprising:

a convey unit for conveying a sheet-like object;

improper feeding detecting means, disposed on a sheet-like object convey path including said convey unit, for detecting improper feeding of the sheet-like object;

a first holding unit disposed downstream of said convey unit in a sheet-like object convey direction and having first holding means for holding the sheet-like object conveyed by said convey unit;

a second holding unit disposed downstream of said first holding unit in the sheet-like object convey direction and having second holding means for holding the sheet-like object held by said first holding unit; and first disable means for disabling said second holding means when said improper feeding detecting means detects improper feeding of the sheet-like object.

2. A unit according to claim 1, wherein said first disable means has a regulating member arranged in said second holding unit to regulate holding operation for the sheet-like object of said second holding means, a cam member which is supported to be movable between a first position to retract from said regulating member and a second position to abut against said regulating member, and which engages with said regulating member, when being located at the second position, to enable said regulating member, and an actuator for moving said cam member from the first position to the second position when said improper paper feeding detecting means detects improper feeding of the sheet-like object.

3. A unit according to claim 2, further comprising control means for driving said actuator in accordance with a signal output from said improper feeding detecting means and indicating improper feeding of the sheet-like object.

4. A unit according to claim 1, wherein said second holding means comprises an openable/closeable gripper member, and said first disable means forcibly closes said gripper member, when said improper feeding detecting means detects improper feeding of the sheet-like object, thereby prohibiting reception of the sheet-like object from said first holding means.

5. A unit according to claim 1, further comprising second disable means for disabling said first holding means when said improper feeding detecting means detects improper feeding of the sheet-like object.

6. A unit according to claim 5, wherein said first holding means comprises a gripper member for holding and releasing the sheet-like object with opening/closing operation, and said second disable means has an opening/closing member arranged in said first holding unit to displace when the sheet-like object is supplied from said convey unit, thereby opening/closing said gripper member, a cam member against which said opening/closing member abuts and which is supported to be movable between a first position to open/close said gripper member in order to hold the sheet-like object and a second position to forcibly open said gripper member in order to prohibit holding of the sheet-like object, and an actuator for moving said cam member from the first position to the second position when said improper paper feeding detecting means detects improper feeding of the sheet-like object.

7. A unit according to claim 6, further comprising control means for driving said actuator in accordance with a signal output from said improper feeding detecting means and indicating improper feeding of the sheet-like object.

8. A unit according to claim 1, wherein said first holding means comprises an openable/closeable gripper member, and said second disable means forcibly opens said gripper member, when said improper feeding detecting means detects improper feeding of the sheet-like object, thereby prohibiting reception of the sheet-like object from said convey unit.

9. A unit according to claim 1, wherein said improper feeding detecting means comprises at least one of a first detector for detecting a sheet-like object that has overreached a stop position downstream of said convey unit in the sheet-like object convey direction, a second detector for detecting at least two overlaying sheet-like objects, and a third detector for detecting a sheet-like object that has skewed and stopped at the stop position.

10. A unit according to claim 1, wherein said first holding unit is an arm-like swing unit which holds the sheet-like object fed from said convey unit with said first holding means provided at a distal end thereof and thereafter swings, and said second holding unit is a convey cylinder which holds the sheet-like object held by said first holding means of said swing unit with said second holding means provided at a circumferential surface thereof, and rotates.

11. A unit according to claim 1, wherein said improper feeding detecting means is disposed downstream of said convey unit in the sheet-like object convey direction.

* * * * *